US008584640B2

(12) United States Patent
Moeck et al.

(10) Patent No.: US 8,584,640 B2
(45) Date of Patent: Nov. 19, 2013

(54) FINGER FOLLOWER OF A VALVE TRAIN

(75) Inventors: Stephan Moeck, Pretzfeld (DE); Michael Kress, Lonnerstadt (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 42 days.

(21) Appl. No.: 13/440,680

(22) Filed: Apr. 5, 2012

(65) Prior Publication Data

US 2012/0260874 A1 Oct. 18, 2012

(30) Foreign Application Priority Data

Apr. 15, 2011 (DE) ..... 10 2011 007 451

(51) Int. Cl.
*F01L 1/18* (2006.01)

(52) U.S. Cl.
USPC ..... 123/90.39; 29/888.2; 74/559; 74/569

(58) Field of Classification Search
USPC ..... 123/90.39; 29/888.2; 74/559, 569
See application file for complete search history.

(56) References Cited

U.S. PATENT DOCUMENTS 7,721,695 B2 * 5/2010 Moeck et al. ..... 123/90.39

FOREIGN PATENT DOCUMENTS

| | | |
|---|---|---|
| DE | 19617523 | 11/1997 |
| DE | 102006052821 | 5/2008 |
| DE | 102007006695 | 8/2008 |

* cited by examiner

*Primary Examiner* — Ching Chang
(74) *Attorney, Agent, or Firm* — Simpson & Simpson, PLLC

(57) ABSTRACT

The invention relates to a finger follower, or lever (1) of a valve train, for example of a piston-type internal combustion engine, with a lever body (2) having an end-sided base web (4), on which there is a spherical cap-shaped bearing cup (8) for an articulated mounting on a bearing pin of a housing-sided support element, said bearing pin terminating as a spherical cap; and on this base web is fastened a retaining clamp (9), engaging with an annular groove of the bearing pin, in order to secure the finger follower (1) on the support element in such a way that said finger follower can move to a limited extent.

6 Claims, 4 Drawing Sheets

FINGER FOLLOWER OF A VALVE TRAIN

CROSS-REFERENCE TO RELATED APPLICATIONS

This patent claims priority from German Patent Application No. DE 10 2011 007 451.1, filed Apr. 15, 2011, which application is incorporated herein by reference in its entirety.

FIELD OF THE INVENTION

The invention relates to a finger follower (lever) of a valve train, for example of a piston-type internal combustion engine, with a lever body having an end-sided base web, on which there is a spherical cap-shaped bearing cup for an articulated mounting on a bearing pin of a housing-sided support element, said bearing pin terminating as a spherical cap; and on this base web is fastened a retaining clamp, engaging with an annular groove of the bearing pin, in order to secure the finger follower on the support element in such a way that it can move to a limited extent.

BACKGROUND OF THE INVENTION

A finger follower (lever) is a transmission element of a valve train, for example, of a piston-type internal combustion engine. This finger follower allows the lift movement of a cam that is produced by the rotation of a camshaft to be transmitted to a lift valve, which is axially opened to exchange the load for the reset force of a valve spring. For this purpose one end of the finger follower (lever) is mounted in an articulated manner on a housing-sided support element; and the opposite end of said finger follower rests against the stem end of the assigned lift valve. Between its ends the side of the finger follower that faces away from the support element and the lift valve makes contact with the assigned cam of the camshaft. As a result, the lift that is predefined by the contour of the cam and has increased in accordance with the effective lever ratio is transmitted to the stem end of the lift valve. In order to obtain a valve train with minimum friction, the finger follower is often designed as a so-called roller-type finger follower, that is, provided with a roller, which is mounted in a rotatable manner and makes contact with the assigned cam of the camshaft.

The present invention is based on a finger follower (lever) comprising a lever body that is designed preferably as a pressed or punched component made of sheet metal, but it can also be fabricated as a casting with subsequent mechanical finishing. The support element-sided end of the lever body has a spherical cap-shaped bearing cup for an articulated mounting on a bearing pin of a housing-sided support element, said bearing pin terminating as a spherical cap. The support element can be, for example, a piston, which is mounted in an axially moveable manner in a vertical hole of the cylinder head of the piston-type internal combustion engine under discussion. In order to compensate for any temperature induced valve play that occurs between the cam of the camshaft and the stem end of the respective lift valve, said piston can be loaded with pressure oil on an inner piston surface.

Since the finger follower and the support element form a module, in which they are adapted to each other, these components are often connected together in a loss-proof manner by means of a retaining clamp. In this case the articulated mounting should not be adversely affected by additional frictional and flexural losses. For this purpose the retaining clamp is usually attached to the respective base web of the lever body in such a way that it engages laterally with an annular groove of the bearing pin without impeding the ability of the finger follower to swivel relative to the support element in the operating direction.

DE 196 17 523 C2 describes a number of embodiments of such retaining clamps, which are designed to some extent as sheet metal retaining clamps, wire retaining brackets and as plastic retaining brackets. One preferred embodiment of a sheet metal retaining clamp has a U-shaped cross section with bifurcated arms of an inner leg and with a closed outer leg. The sheet metal retaining clamp is pushed from the outside in the longitudinal direction onto the base web of the lever body exhibiting the bearing cup and is locked on said base web with the end-sided retaining lug. In the assembled state the bifurcated arms of the inner leg engage laterally with the annular groove of the bearing pin, so that the finger follower and the support element are connected together in a form locking manner with play.

A preferred embodiment of a wire retaining bracket according to this prior art has two parallel bracket arms, which in the assembled state engage laterally with the annular groove of the bearing pin and are externally connected together by means of a connecting bracket. Both the free inner ends and the outer ends of the bracket arms that are connected together by the connecting bracket are bent upwards at right angles and are provided with a retaining lug formed thereon, so that it is possible to push the wire retaining bracket on, starting from the bearing side, and to fasten it in a form and force locking manner to the associated base web of the lever body.

The figures in DE 10 2006 052 821 A1, which presents a specific design of the valve-sided end of a lever body of a follower finger (lever) designed as a pressed and punched component made of sheet metal, show a sheet metal retaining clamp, which is configured in a manner similar to the sheet metal retaining clamp known from DE 196 17 523 C2. The distinction between the former and the sheet metal retaining clamp of the present invention lies in the fact that its inner leg has a connecting web, which is formed in the manner of a retaining clip and which connects the lateral arms. As a result, the inner leg of the sheet metal retaining clamp is designed as a closed sheet metal spring frame with higher flexural and torsional strength.

The figures in DE 10 2007 006 695 A1, which proposes another design of the valve-sided end of a lever body of a follower finger (lever) designed as a pressed and punched component made of sheet metal, show a sheet metal retaining clamp, which practically consists of only one sheet metal spring frame, which is arranged on the bearing side on the respective base web of the lever body and corresponds to the inner leg of the sheet metal retaining clamp known from DE 10 2006 052 821 A1. The connecting webs of the lateral arms are bent upwards at right angles in a manner similar to the wire retaining bracket known from DE 196 17 523 C2 and is formed into a retaining clip on the end side. This design makes it possible to slide the sheet metal retaining clamp starting on, from the bearing side, and to lock it on the respective base web of the lever body.

Experience with conventional valve trains has shown that the prior art retaining clamps are totally adequate for securing in a loss-proof manner the finger follower at the support element in the course of assembly and also in the event of malfunctions in operation, for example due to a faulty supply of oil to the hydraulic system. If, however, a finger follower and the associated roller are designed relatively narrow and are loaded with a transverse force, there is the risk that the lever body will tilt sideways and slip off the support element. This applies, in particular, to variable valve trains with cam shifting systems, like the Audi valve lift system (AVS) and the cam shifting system (INA), where, instead of cams, which are rigidly connected to the camshaft, a cam body with two or three different, axially adjacent cams are provided. Each cam body is mounted in a rotationally rigid and axially displaceable manner on the cam shaft by means of a drive gear and is axially displaceable with the assigned roller by means of a link motion, in order to switch to another cam in the contact region of the cam heel. In this case the lever body and the rollers are designed relatively narrow because of the limited installation space and are loaded with a transverse force when changing the active cam.

SUMMARY OF THE INVENTION

The invention is based on the knowledge that it is possible to effectively prevent the finger follower from tilting sideways and slipping off the support element, if the retaining clamp is supported at least partially in a form locking manner on the lever body in the pulling direction and in the transverse direction.

A general object of the invention is to provide a finger follower (lever) of a valve train of the design described in the introductory part, with a lever body that is secured at the support element by means of a retaining clamp on the end side. In this context the retaining clamps and their attachment to the lever body are improved especially in terms of supporting the finger follower from tilting sideways and sliding off the support element.

The engineering object of the invention is achieved in connection with the features of the invention as claimed by the fact that the retaining clamp is designed as a sheet metal retaining clamp having the following features:

- a sheet metal spring frame, comprising two parallel longitudinal arms, which engage laterally with the annular groove of the bearing pin, and two connecting webs, which connect the two longitudinal arms on the face end, and said sheet metal spring frame rests against the end-sided base web of the lever body on the bearing side in the region of the bearing cup,
- a retaining tab, which is formed on the inner connecting web and which consists of a retaining web, which is bent substantially upwards at right angles, and a retaining clip, which is formed on the end side, and which rests against and is locked on the inner edge of the end-sided base web, and—a retaining bracket, which is formed by the outer ends of the two longitudinal arms and the outer connecting web, said ends being bent upwards at right angles; and said retaining bracket encircles a tab, which is formed on the outer edge of the end-sided base web and projects in the longitudinal direction.

Working on the aforesaid, the invention is based on a well-known finger follower (lever) of a valve train, for example of a piston-type internal combustion engine, with a lever body having an end-sided base web, on which there is a spherical cap-shaped bearing cup for an articulated mounting on a bearing pin of a housing-sided support element, said bearing pin terminating as a spherical cap. A retaining clamp, engaging with an annular groove of the bearing pin, is fastened to this base web of the lever body, in order to secure the finger follower on the support element in such a way that it can move to a limited extent.

According to the invention, the retaining clamp is designed as a sheet metal retaining clamp, which consists in essence of a sheet metal spring frame resting against the end-sided base web of the lever body on the bearing side in the region of the bearing cup.

The sheet metal spring frame has two parallel longitudinal arms, which in the assembled state engage laterally with the annular groove of the bearing pin, and two connecting webs, which connect the longitudinal arms. The inner connecting web has a retaining tab, which consists of a retaining web, which is bent substantially upwards at right angles, and a retaining clip, formed on the end side. In the assembled state this retaining tab rests against and is locked on the inner edge of the end-sided base web. The outer connecting web is bent upwards at right angles together with the outer ends of the two longitudinal arms and forms a retaining bracket, which in the assembled state encircles a tab, which is formed on the outer edge of the end-sided base web and projects in the longitudinal direction.

For assembly purposes the retaining clamp according to the invention is placed on the tab in such a way that it is bent with the retaining bracket sloping downwards, that is, in the direction of the support element. Then said retaining clamp rests against the bearing side of the base web in a swivel motion and locks with the retaining tab on the inner edge of the base web.

Since the tab of the end-sided base web is encircled in a form locking manner by the retaining bracket, the retaining clamp is very effective against jumping off in the pulling direction and is ensured against lateral slipping and tilting. Consequently this retaining clamp and its attachment to the lever body substantially eliminate the possibility of the finger follower tilting laterally and slipping off the support element. Therefore, the finger follower according to the invention lends itself well to use in a variable valve train with a cam shifting system.

In order to further increase the stability of the inner attachment of the retaining clamp, the inner edge of the end-sided base web has advantageously a recess for the engagement of the retaining tab of the retaining clamp. The width of said recess is slightly larger than the width of the retaining tab. As a result, it is not possible for the retaining tab to tilt laterally and slip off and, with it, the retaining clamp from the lever body in this region.

In order to make also the outer attachment of the retaining clamp on the end-sided base web especially stable and without play, it is preferably provided that the width of the protruding tab is slightly smaller than the inner distance of the longitudinal arms of the retaining clamp; and that the inner height of the retaining bracket is slightly larger than the thickness of the protruding tab.

This feature can prevent at least one of the longitudinal arms of the retaining clamp from jumping out of the annular groove of the bearing pin, in that the snap dimensions of the retaining clamp, said dimensions giving the bilateral undercut with the spherical cup of the bearing pin, are below the nominal diameter of the spherical cap of the bearing pin by 0.8 mm+/−0.1 mm. In contrast to the retaining clamps used in the past, this corresponds to a decrease of 0.2 mm in the snap dimension.

Another increase in the flexural and torsional strength of the retaining clamp and, with it, the stability of the finger follower against lateral tilting and slipping off the support element can be attained by increasing the sheet metal thickness of the retaining clamp. As a result, the sheet metal thickness of the retaining clamp that is used and that had been approximately 0.3 mm to date, is now in a range of 0.4 mm to 0.6 mm and amounts preferably to 0.5 mm.

In order to prevent a lateral tilting and slipping of the finger follower off of the support element, the retaining clamp is designed as a sheet metal retaining clamp having the following features: a sheet metal spring frame (13), comprising two parallel longitudinal arms (10*a*, 10*b*), which engage laterally with the annular groove of the bearing pin, and two connecting webs (11, 12), which connect the two longitudinal arms on the face end, and said sheet metal spring frame rests against the end-sided base web of the lever body on the bearing side in the region of the bearing cup (8); a retaining tab (14), which is formed on the inner connecting web (11) and which consists of a retaining web (15), which is bent substantially upwards at right angles, and a retaining clip (16), which is formed on the end side, and which rests against and is locked on the inner edge (18) of the end-sided base web; and a retaining bracket (17), which is formed by the outer ends of the two longitudinal arms and the outer connecting web (12), said ends being bent upwards at right angles; and said retaining bracket encircles a tab (21), which is formed on the outer edge (20) of the end-sided base web and projects in the longitudinal direction.

BRIEF DESCRIPTION OF THE DRAWINGS

The invention is explained in detail below by means of an exemplary embodiment with reference to the accompanying drawings. Referring to the drawings.

DETAILED DESCRIPTION OF THE INVENTION

Figure 1:
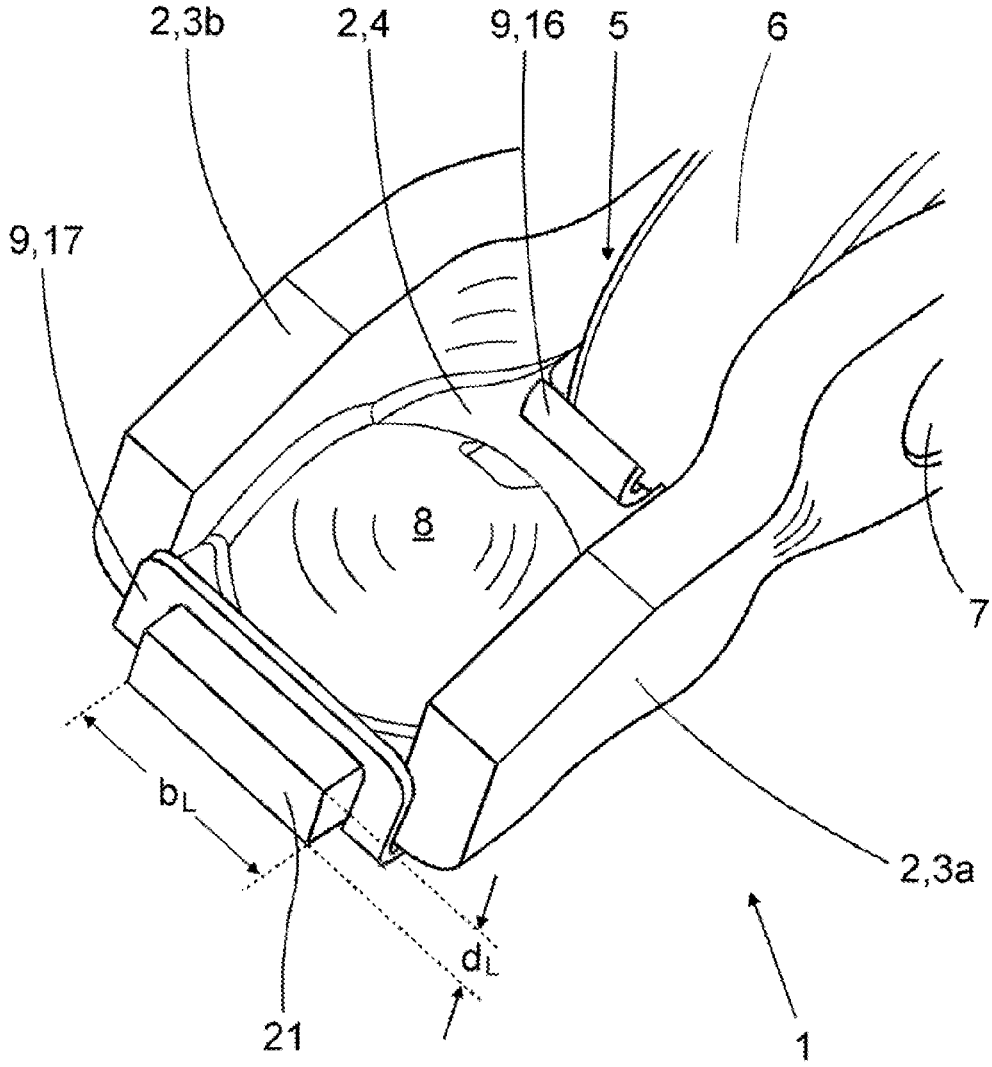
FIG. 1 is a perspective sectional view of an inventive follower finger with the retaining clamp installed.
Figure 3:
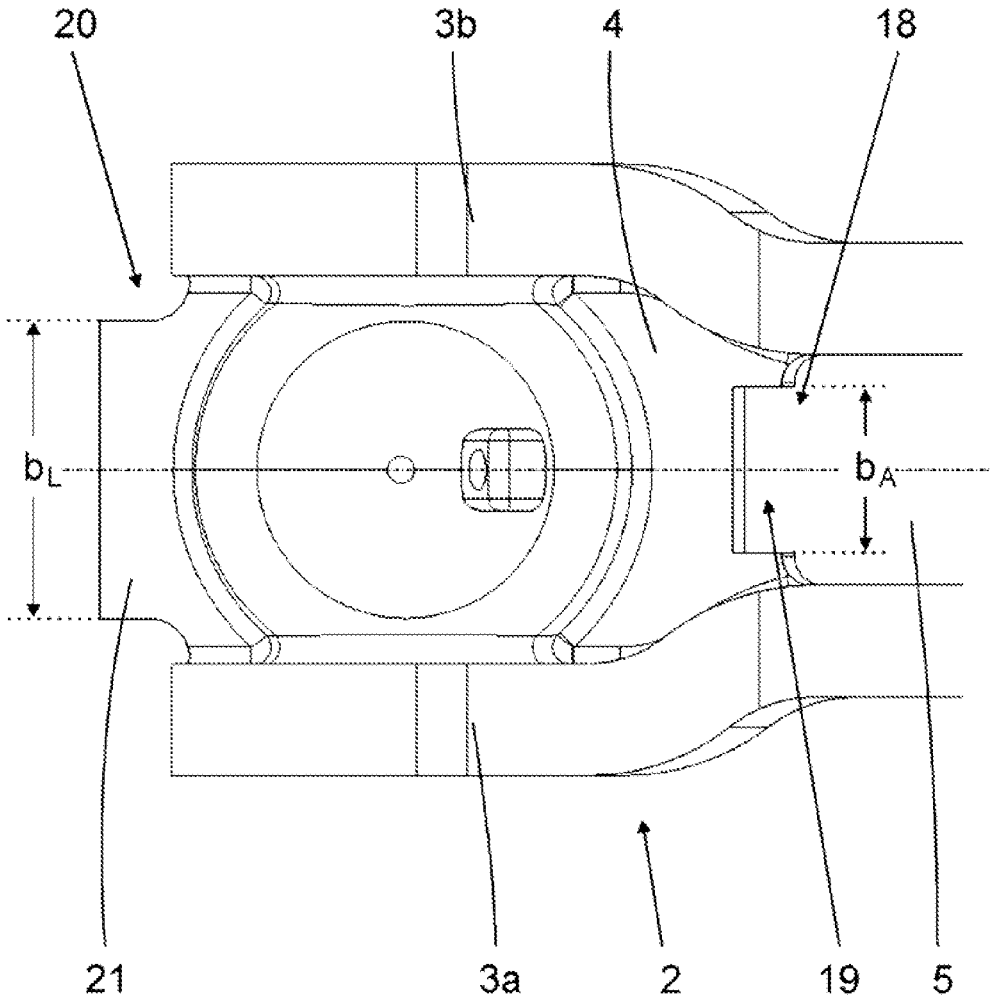
FIG. 3 shows the lever body of the finger follower (lever) from FIG. 1 without any other components in a top view from the outside; and, FIG. 4 shows the finger follower from FIG. 1 with the installed retaining clamp from FIG. 2 in a top view from the inside.
Figure 4:
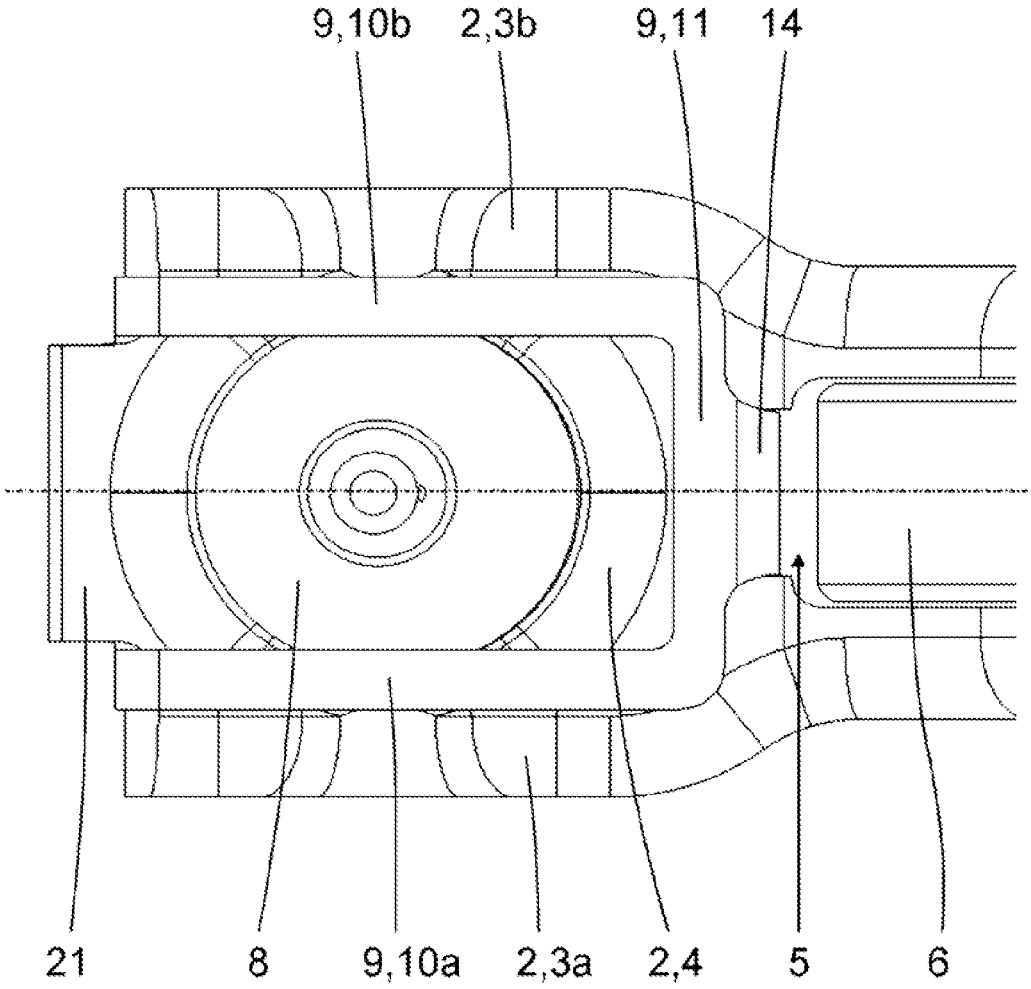

A finger follower 1 of a valve train that is designed as a roller-type finger follower and that is shown in the perspective sectional view on the bearing-sided part in FIG. 1 and in the top view from the inside in the axial direction of sight of a cylindrical housing-sided support element in FIG. 4, consists in essence of a lever body 2, which is designed as a pressed and punched component made of sheet metal and of which FIGS. 1, 3 and 4 show only the bearing-sided web section. This lever body 2 has a U-shaped cross section with two substantially parallel side walls 3*a*, 3*b* and a base web 4, which connects the two side walls 3*a*, 3*b* and is interrupted by a roller pocket 5. Between the side walls 3*a*, 3*b* there is a roller 6, which is mounted in a rotatable manner on a bolt and which projects through the roller pocket 5. In the assembled state, this roller makes contact with the assigned cam of a camshaft that is not illustrated. The bolt is inserted at both ends into a hole 7 punched out of the side wall 3*a*, 3*b* and caulked at the end.

The web section 4 of the bearing-sided portion of the lever body 2 that is shown in FIGS. 1 and 4 has a bearing contour 8, designed as a spherical cap-shaped bearing cup, for an articulated mounting of the lever body 2 on a bearing pin of a housing-sided support element that is not illustrated, said bearing pin terminating as a spherical cap. A retaining clamp 9, which engages with an annular groove of the bearing pin, is fastened on the web section 4, in order to secure the lever body 2 on the support element in such a way that said lever body can be moved to a limited extent.

Figure 2:
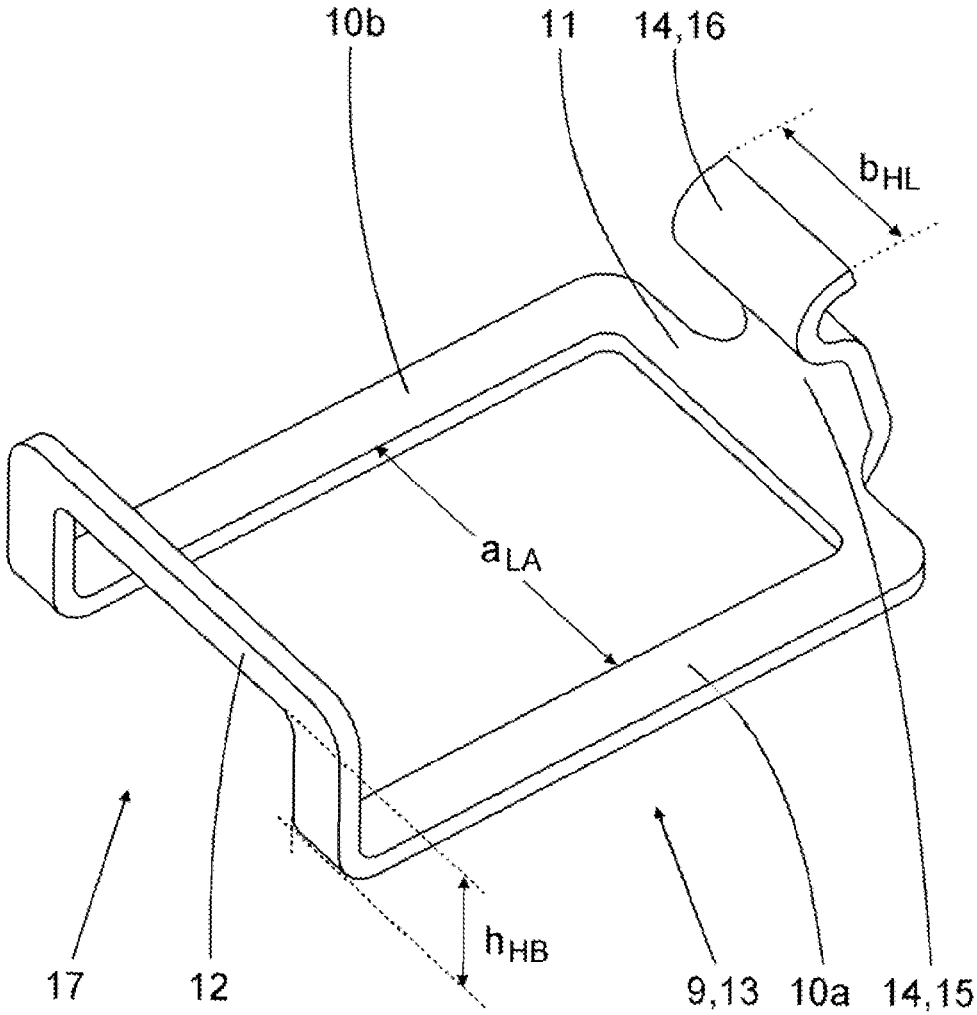
FIG. 2 is a perspective single element view of the retaining clamp from FIG. 1.

It is very clear from the single element view of FIG. 2 that the retaining clamp 9 is designed as a sheet metal retaining clamp and comprises in essence a sheet metal spring frame 13, which consists of two parallel longitudinal arms 10*a*, 10*b* and two connecting webs 11, 12, which connect the two longitudinal arms 10*a*, 10*b* on the face side. The inner connecting web 11 has a retaining tab 14, which consists of a retaining web 15, which is bent substantially upwards at right angles, and a retaining clip 16, which is formed on the end. The outer connecting web 12 is bent upwards and/or outwards at right angles together with the outer ends of the two longitudinal arms 10*a*, 10*b*, in order to form a retaining bracket 17.

In the assembled state (see FIG. 1 and FIG. 4) the retaining clamp 9 rests together with the sheet metal spring frame 13 against the end-sided base web or more specifically the web section 4 of the lever body 2 on the bearing side—that is, on the interior facing the support body—in the region of the bearing cup 8. At the same time the retaining tab 14, which is formed on the inner connecting web 11, engages with a recess 19, arranged at the inner edge 18 of the end-sided base web 4, and is locked together with the inner edge 18 of the end-sided base web 4 by means of the retaining clip 16. Then the external retaining bracket 17 of the retaining clamp 9 encircles in a form locking manner a tab 21, which is formed on the outer edge 20 of the end-sided base web 4 and projects in the longitudinal direction. The recess 19, which is incorporated in the end-sided base web 4 of the lever body 2, and the tab 21, which is formed on said base web, are shown very clearly in FIG. 3, where the lever body 2 is depicted without any other components in a top view from the inside, that is, in the axial direction of viewing from the support element.

In order to guarantee a substantially play free attachment of the retaining clamp 9 to the end-sided base web 4, the width $b_A$ of the recess 19 is only slightly larger than the width $b_{HL}$ of the retaining tab 14. For this purpose it is also provided that the width $b_L$ of the tab 21 is only slightly smaller than the inner distance $a_{LA}$ of the longitudinal arms 10*a*, 10*b* of the retaining clamp 9; and that the inner height $h_{HB}$ of the retaining bracket 17 is slightly larger than the thickness $d_L$ of the tab 21.

Owing to the inventive design of the retaining clamp 9 and its attachment to the lever body 2, a stable support of the finger follower 1 against a lateral tilting and slipping off of the support element is attained. Therefore, the finger follower 1 according to the inventive lends itself especially well to use in a variable valve train with a cam shifting system.

Reference Numerals and Designations

1 finger follower (lever)
2 lever body
3*a*, 3*b* side wall
4 base web, web section
5 roller pocket
6 roller
7 hole
8 bearing contour, bearing cup
9 retaining clamp
10*a*, 10*b* longitudinal arm of the retaining clamp
11 inner connecting web of the retaining clamp
12 outer connecting web of the retaining clamp
13 sheet metal spring frame
14 retaining tab
15 retaining web of the retaining tab
16 retaining clip of the retaining tab
17 retaining bracket
18 inner edge of the base web 4
19 recess
20 outer edge of the base web 4
21 tab
$a_{LA}$ inner distance of the longitudinal arm of the retaining clamp $b_A$ width of the recess 19
$b_{HL}$ width of the retaining tab 14
$b_L$ width of the tab 21
$d_L$ thickness of the tab 21
$h_{HB}$ height of the retaining bracket 17

What is claimed is:

1. A finger follower (1) of a valve train, of a piston-type internal combustion engine, with a lever body (2) having an end-sided-based web (4), in which there is a spherical cap-shaped bearing cup (8) for an articulated mounting on a bearing pin of a housing-sided support element, said bearing pin terminating as a spherical cap; and on the end-sided-base web (4) is fastened a retaining clamp (9), engaging with an annular groove of the bearing pin, in order to secure the finger follower (1) on the support element in a way that said finger follower can move to a limited extent, wherein the retaining clamp (9) is designed as a sheet metal retaining clamp having the following features:

a sheet metal spring frame (13), comprising two parallel longitudinal arms (10*a*, 10*b*), which engage laterally with the annular groove of the bearing pin, and two connecting webs (11, 12), which connect the two parallel longitudinal arms (10*a*, 10*b*) on a face end, and said sheet metal spring frame rests against the end-sided-base web (4) of the lever body (2) on the bearing side in the region of the spherical cap-shaped bearing cup (8);

a retaining tab (14), which is formed on an inner connecting web (11) and which comprises a retaining web (15), which is bent substantially upwards at right angles, and a retaining clip (16), which is formed on an end side, and which rests against and is locked on an inner edge (18) of the end-sided-based web (4), and, a retaining bracket (17), which is formed by outer ends of the two parallel longitudinal arms (10*a*, 10*b*) and an outer connecting web (12), and ends of said retaining bracket being bent upwards at right angles; and said retaining bracket encircles a tab (21), which is formed on an outer edge (20) of the end-sided-based web (4) and projects in the longitudinal direction.

2. The finger follower recited in claim 1, wherein the inner edge (18) of the end-sided base web (4) has a recess (19) for the engagement of the retaining tab (14) of the retaining clamp (9); and the width ($b_A$) of said recess is slightly larger than the width ($b_{HL}$) of the retaining tab (14).

3. The finger follower recited in claim 1, wherein the width ($b_{HL}$) of the protruding tab (21) is slightly smaller than the inner distance ($a_{LA}$) of the longitudinal arms (10*a*, 10*b*) of the retaining clamp (9); and that the inner height ($h_{HB}$) of the retaining bracket (9) is slightly larger than the thickness ($d_L$) of the protruding tab (21).

4. The finger follower recited in claim 1, wherein the snap dimensions of the retaining clamp (9) are below the nominal diameter of the spherical cap of the bearing pin by 0.8 mm+/−0.1 mm.

5. The finger follower recited in claim 1, wherein the sheet metal thickness of the retaining clamp (9) is in a range of 0.4 mm to 0.6 mm.

6. The finger follower recited in claim 5, wherein the sheet metal thickness of the retaining clamp (9) is 0.5 mm.

* * * * *